US005942852A

United States Patent [19]

Goebel et al.

[11] Patent Number: 5,942,852

[45] Date of Patent: Aug. 24, 1999

[54] EFFICIENT, HIGHLY LINEAR TRAVELING WAVE TUBE USING COLLECTOR WITH HIGH BACKSTREAMING CURRENT UNDER SATURATED DRIVE

[75] Inventors: Dan M. Goebel, Tarzana; Edward A. Adler; William L. Menninger, both of Los Angeles, all of Calif.

[73] Assignee: Hughes Electronics Corporation, Los Angeles, Calif.

[21] Appl. No.: 08/869,842

[22] Filed: Jun. 5, 1997

[51] Int. Cl.[6] ..... H01J 25/34; H01J 23/027

[52] U.S. Cl. ..... 315/3.5; 315/5.38

[58] Field of Search ..... 315/3.5, 5.38

[56] References Cited

U.S. PATENT DOCUMENTS

| | | | |
|---|---|---|---|
| 3,433,999 | 3/1969 | Espinosa | 333/248 X |
| 3,806,755 | 4/1974 | Lien et al. | 315/5.38 |
| 3,936,695 | 2/1976 | Schmidt | 315/5.38 X |
| 4,506,190 | 3/1985 | Symons | 315/5.38 X |

*Primary Examiner*—Benny T. Lee
*Attorney, Agent, or Firm*—Terje Gudmestad; Georgann S. Grunebach; Michael W. Sales

[57] ABSTRACT

A traveling wave tube apparatus and method is disclosed. The traveling wave tube includes a slow wave structure such as a helix member. The helix member has an input end for receiving a microwave input signal having a selected power level and an output end for supplying a microwave output signal having a given power level. A microwave source is connected to the input end of the helix member for applying the microwave input signal to the helix member. An electron gun assembly is adjacent the input end of the helix member and has a cathode for injecting electrons as an electron beam through the helix member. A collector assembly is adjacent the output end of the helix member and has at least four collector electrodes for collecting the electrons in the electron beam. The power level of the microwave input signal is selected such that the given power level of the microwave output signal is at least 3 dB lower than the power level of the microwave output signal at saturation. The geometry of the electrodes and bias voltages applied to the electrodes are selected to optimally handle an electron beam of a traveling wave tube operating at least 3 dB backed off from saturation so as to maximize the collection efficiency. The geometry of the electrodes and bias voltages applied to the electrodes are selected such that the collector assembly generates a high level of backstreaming current when the traveling wave tube operates at saturation.

5 Claims, 3 Drawing Sheets

EFFICIENT, HIGHLY LINEAR TRAVELING WAVE TUBE USING COLLECTOR WITH HIGH BACKSTREAMING CURRENT UNDER SATURATED DRIVE

TECHNICAL FIELD

The present invention relates generally to traveling wave tubes and, more particularly, to a traveling wave tube operating backed off from saturation and having a multiple stage collector providing a superior collection efficiency when operated backed off. This superior collection efficiency is obtained by allowing the collector to have high backstreaming current when running saturated.

BACKGROUND ART

A traveling wave tube is a vacuum device which serves as an amplifier of microwave frequency energy. It relies upon the energy interaction that occurs between an electron beam and a microwave frequency signal. An electron gun at an input end of a slow wave structure (SWS) generates the electron beam. The electron beam travels along an axial path through the SWS. A microwave source inputs the microwave signal at the input end of the structure. The microwave signal then propagates along the SWS towards an output end of the SWS.

The SWS causes the microwave signal to traverse an extended distance between two axially spaced points. This reduces the effective lateral propagation velocity of the microwave signal from that of light to that of the electron beam. Interaction between the electron beam and the microwave signal causes velocity modulation and bunching of the electrons in the beam. The interaction also causes energy coupling to take place between the electron beam and the microwave signal that amplifies the signal. The amplified microwave signal is then coupled at the output end.

The amount of coupling between the electron beam and the microwave signal is approximately constant at low microwave signal input power levels. Thus, the gain between the microwave output and input signals is nearly constant. As the power of the microwave input signal increases, nonlinear effects become more significant. Eventually, the microwave output signal reaches a maximum power value and the traveling wave tube operates at saturation. Approaching saturation, the relationship between the microwave output and input signals starts to decline. If the power of the microwave input signal is increased further beyond saturation, the power of the microwave output signal and the gain decrease. A traveling wave tube operating below its saturated microwave output power is described as running backed off from saturation.

The power of the microwave output signal is also proportional to the electron beam power. Saturation of the traveling wave tube occurs, regardless of the power of the microwave input signal, when the power of the microwave output signal is roughly 5% to 50% of the electron beam power. Accordingly, for multiple signal communication applications requiring high amplitude and phase linearity, the microwave output power must be roughly 2% to 15% of the electron beam power and 5% to 50% of the saturated microwave output power.

The traveling wave tube further includes a collector for collecting the electrons in the electron beam after they have traveled through the SWS to collect the power in the beam. The power of the electron beam which has not been coupled to the microwave signal is referred to as the unused power in the spent electron beam.

Running backed off from saturation, the electrons in the electron beam have a small energy spread. Also, the velocity of the electrons remains generally axial because of minimal perturbance by the microwave signal.

Operating at saturation, the energy spread of the electron beam is large because the perturbance of the microwave signal with the beam causes some of the electrons to rapidly accelerate and decelerate. For instance, some electrons may lose as much as 50% of their initial energy while others may gain as much as 20% of their initial energy. The significant perturbance during operation at saturation, also causes the electron beam to have large radial velocity components.

Typical traveling wave tubes are built to produce the desired saturated microwave output power and then are run backed off from saturation to obtain the desired amplitude and phase linearity. This limits the performance of the traveling wave tube because the collector is designed to electrically operate at saturation. The backstreaming current, or current returned from the collector, is typically limited to less than 5% of the cathode current at saturation. In particular, the collector of a typical traveling wave tube generally has no more than four stages because the collection efficiency increases slightly with additional stages when the tube is operating at saturation. Furthermore, because the electron beam has a large energy spread and large radial velocity components at saturation, the geometry of the stages and the voltages applied to the stages are set to handle a highly divergent beam. For instance, the stages are positioned at a large angle with respect to the walls of the collector and the difference in voltages applied to the first and last stages is relatively small.

However, because the electron beam has a small energy spread and a general axial velocity during backed off operation, the efficiency of collecting the electrons may be increased with a novel collector implementation.

SUMMARY OF THE INVENTION

Accordingly, it is an object of the present invention to provide a traveling wave tube apparatus providing superior amplitude and phase linearity and having a multiple stage collector providing a superior collection efficiency.

It is another object of the present invention to provide a method of operating a traveling wave tube apparatus such that the tube provides a superior amplitude and phase linearity and has a superior collection efficiency.

In carrying out the above objects and other objects, the present invention provides a traveling wave tube apparatus. The traveling wave tube apparatus includes a slow wave structure (SWS). The SWS has an input end for receiving a microwave input signal having a selected power level and an output end for supplying a microwave output signal having a given power level. A microwave source is connected to the input end of the SWS for applying the microwave input signal to the SWS. An electron gun assembly is adjacent the input end of the SWS and has a cathode for injecting electrons as an electron beam through the SWS. A collector assembly is adjacent the output end of the SWS and has at least four collector electrodes for collecting the electrons in the electron beam. The power level of the microwave input signal is selected such that the given power level of the microwave output signal is at least 3 dB lower than the power level of the microwave output signal at saturation. The geometry of the electrodes and bias voltages applied to the electrodes are selected to optimally handle an electron beam of a traveling wave tube operating at least 3 dB backed off from saturation so as to maximize the collection efficiency. A major consequence of this design approach is that the collector assembly generates a high (>5% of the cathode current) backstreaming current when the tube is saturated.

Further, in carrying out the above objects and other objects, the present invention provides a method for operating a traveling wave tube apparatus. The method is for a traveling wave tube apparatus provided with a SWS having an input end for receiving a microwave input signal having a selected power level and an output end for supplying a microwave output signal having a given power level. The traveling wave tube apparatus is further provided with a collector assembly having at least four electrodes.

The method includes injecting electrons at the input end of the SWS to form an electron beam through the helix member. The microwave input signal having the selected power level is then applied to the input end of the SWS. The power level of the microwave input signal is selected such that the given power level of the microwave output signal is at least 3 dB lower than the power level of the microwave output signal at saturation. The electrons in the electron beam are then collected at the output end of the SWS with the collector assembly. The geometry of the electrodes and bias voltages applied to the electrodes are selected to optimally handle an electron beam of a traveling wave tube operating at least 3 dB backed off from saturation so as to maximize the collection efficiency. The traveling wave tube must be operated at least 3 dB backed off from saturation or a high backstreaming current results.

Preferably, the electron beam has a given power level and the power level of the microwave input signal is selected such that the power level of the microwave output signal is six to fifty times lower than the given power level of the electron beam.

The advantages accruing to the present invention are numerous. The traveling wave tube apparatus is operated backed off from saturation such that it provides a high amplitude and phase linearity for communication applications. The traveling wave tube apparatus is extremely efficient, especially when compared to solid state amplifiers, because the microwave output power is so low (at least 3 dB below the saturated microwave output power). The electron beam is not significantly perturbed by the microwave signal as a result of the backed off operation. Thus, a high number of collector electrodes or stages having a geometry and bias voltages selected to handle a relatively unperturbed electron beam is effective in collecting most of the spent beam energy of the beam.

For example, a solid state microwave amplifier in the L-Band (1.0 to 2.0 GHz) has an efficiency in the linear regime of approximately 10%. In contrast, the traveling wave tube apparatus of the present invention has an efficiency of two to three times that of the solid state amplifier and twice its linear output power.

These and other features, aspects, and embodiments of the present invention will become better understood with regard to the following description, appended claims, and accompanying drawings.

BEST MODES FOR CARRYING OUT THE INVENTION

Figure 1:
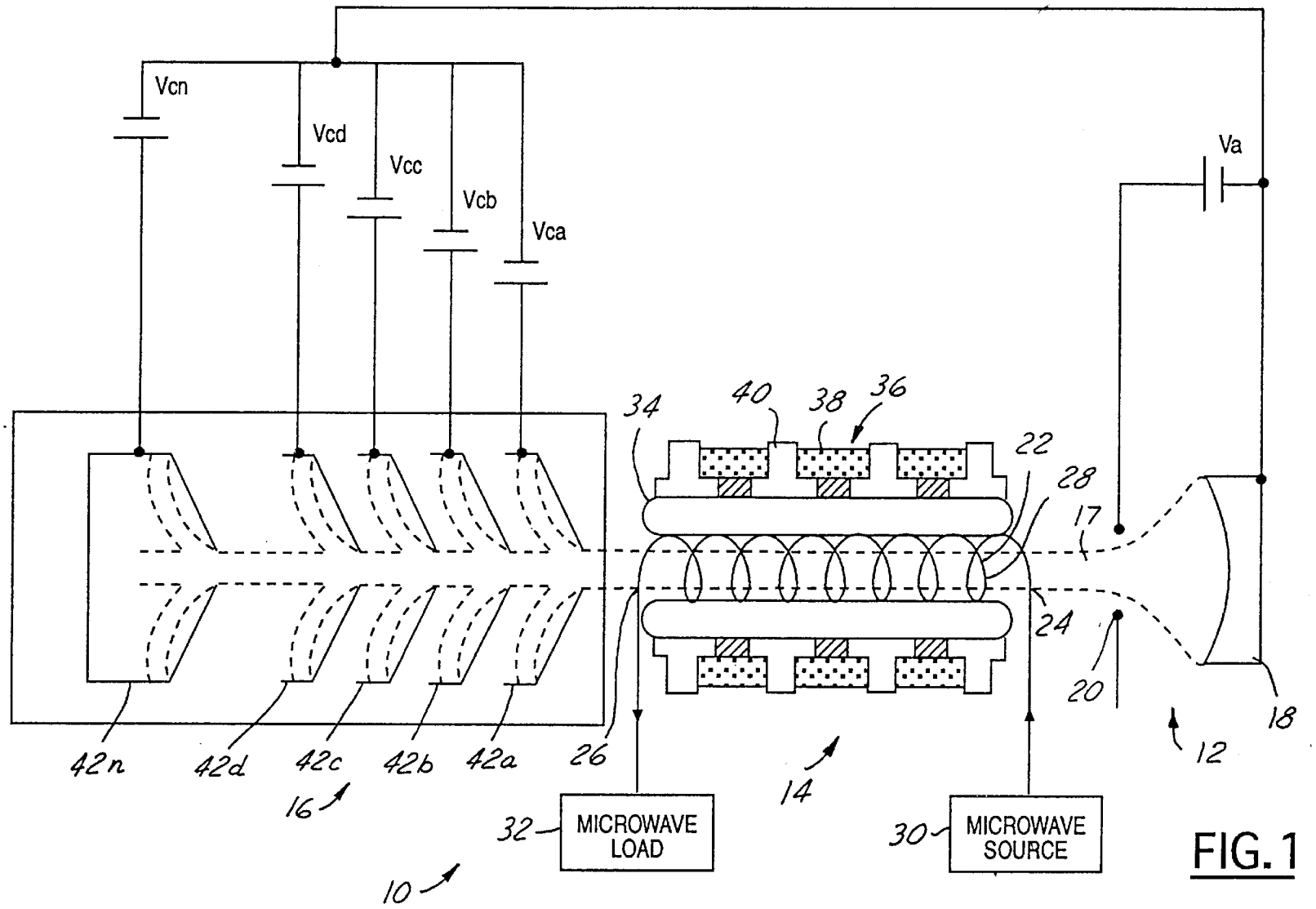
FIG. 1 is a schematic view of a traveling wave tube apparatus according to the present invention.

Referring now to FIG. 1, a traveling wave tube apparatus 10 according to the present invention is shown. Traveling wave tube 10 includes an electron gun assembly 12, a slow wave structure (SWS) 14, and a collector assembly 16. Electron gun assembly 12 injects electrons to generate an electron beam 17. Electron gun assembly 12 includes a cathode 18 and an anode 20. A negative voltage $V_a$ is applied to cathode 18 and a corresponding positive voltage is applied to anode 20. Cathode 18 is the source of the electrons for electron beam 17. Anode 20 accelerates and focuses the electrons. The power of electron beam 17 depends on the cathode voltage $V_a$ and the cathode current I.

SWS 14 preferably is an electrically conductive helix member 22 made of tungsten, molybdenum, or the like. Of course, SWS 14 may be a coupled-cavity circuit (not specifically shown) instead of helix member 22. Helix member 22 has an input end 24 and an output end 26. Electron gun assembly 12 is adjacent input end 24 and electron beam 17 travels along an axial path through helix member 22 from input end 24 towards output end 26. A microwave source 30 is connected to input end 24 for applying a microwave input signal to helix member 22. Microwave input signal propagates along helix member 22 toward output end 26. Helix member 22 causes the microwave signal to traverse an extended distance between two axially spaced points to reduce the effective lateral propagation velocity of the microwave signal to that of electron beam 17. By lowering the propagation velocity, energy coupling is caused to take place between electron beam 17 and the microwave signal that amplifies the signal. A microwave load 32 is connected to output end 26 for receiving an amplified microwave output signal from helix member 22.

SWS 14 is positioned within a metal tube member (not specifically shown). Supporting rods 34 are positioned between helix member 22 and the tube member for supporting the helix member and conducting heat away. A periodic permanent magnet (PPM) arrangement 36 positioned outside of the tube member is also provided. PPM arrangement 36 includes a permanent magnet 38 and an integral pole piece barrel 40. PPM arrangement 36 focuses and keeps the electron beam within helix member 22.

Collector assembly 16 is adjacent output end 26 of helix member 22. Collector assembly 16 includes a number of collector electrodes 42*a*, 42*b*, 42*c*, 42*d*, 42*n*. Collector electrodes 42*a*, 42*b*, 42*c*, 42*d*, 42*n* collect electrons in electron beam 17 to recover the electron beam power which was not used in generating the microwave output signal. This power is referred to as the unused power in the spent electron beam. Some of the unused power is converted to heat by the electrons striking collector electrodes 42*a*, 42*b*, 42*c*, 42*d*, 42*n*. Thus, bias voltages ($V_{ca}$, $V_{cb}$, $V_{cc}$, $V_{cd}$, $V_{cn}$) are applied to collector electrodes 42*a*, 42*b*, 42*c*, 42*d*, 42*n* to slow down the electrons before they strike the collector electrodes to enable the electrodes to recover more power and reduce heat power losses. The bias voltages are selected to handle a relatively unperturbed electron beam at back off. In particular, the difference in voltage between the first and last electrode is relatively large. Preferably, collector electrodes 42*a*, 42*b*, 42*c*, 42*d*, 42*n* comprise graphite to minimize the secondary electron yield. The geometry of the electrodes is also selected to handle the relatively unperturbed electron beam at back off. In particular, the electrodes are positioned at a small angle with respect to the walls of the collector. Thus, more electrodes may fit within a given volume. The efficiency of collector assembly 16 in recovering the unused power from spent electron beam 17 is known as the collection efficiency $\eta_{coll}$. A particular consequence of this choice of collector geometry and voltage selection is that a large backstreaming current occurs when the traveling wave tube is operated at saturation.

The collection efficiency $\eta_{coll}$ is one of two main factors which influence the overall efficiency $\eta_{ov}$ of traveling wave tube 10. The overall efficiency $\eta_{ov}$ is the ratio of the output power of the microwave output signal to the total input power of traveling wave tube 10. The total input power includes the power of electron beam 17, the power required for heating cathode 18 and operating PPM arrangement 36, and the like subtracted from the power recovered by collector assembly 16. The second main factor is the electronic efficiency $\eta_e$ which is the ratio of the output power of the microwave output signal to the power of electron beam 17. The electronic efficiency $\eta_e$ is referred to as the basic efficiency $\eta^b$ when traveling wave tube 10 is operating at saturation. Thus, the basic efficiency $\eta_b$ is the ratio of the saturated microwave output power to the power of electron beam 17.

Figure 2:
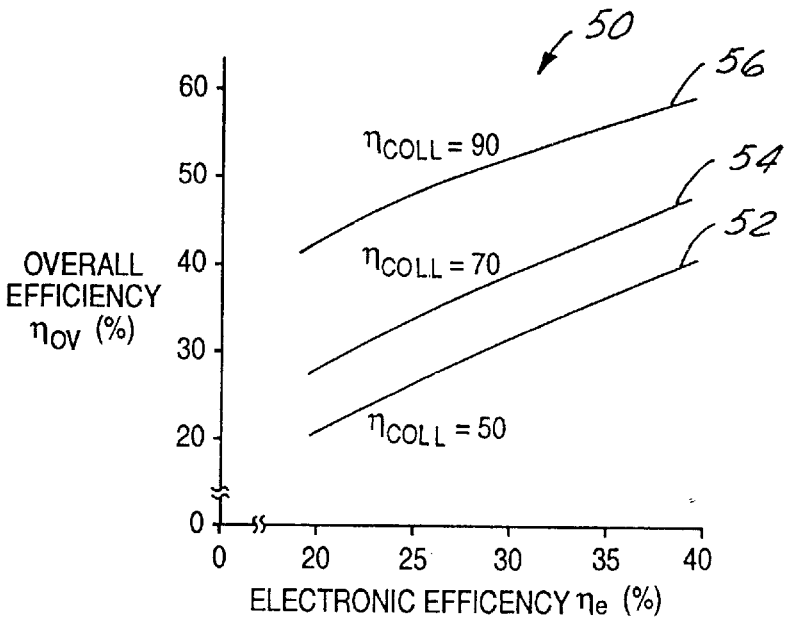
FIG. 2 is a graph of the overall efficiency ($\eta_{ov}$) as a function of the electronic efficiency ($\eta_e$) for three collection efficiencies ($\eta_{coll}$)

Referring now to FIG. 2, a graph 50 of the overall efficiency ($\eta_{ov}$) as a function of the electronic efficiency ($\eta_e$) for three collection efficiencies $\eta_{coll}$ is shown. Plot 52 shows the variation of the overall efficiency $\eta_{ov}$ as a function of the electronic efficiency $\eta_e$ when the collection efficiency $\eta_{coll}$ is 50%. Plots 54 and 56 show the variation when the collection efficiency $\eta_{coll}$ is 70% and 90% respectively. Graph 50 shows that the overall efficiency $\eta_{ov}$ depends strongly on the collection efficiency $\eta_{coll}$, especially for high collection efficiencies. Thus, traveling wave tube 10 is operated and designed such that the collection efficiency $\eta_{coll}$ is maximized.

To maximize the linearity traveling wave tube 10 operates backed off from saturation. The amount of back off ($\Delta$) determines the linearity of traveling wave tube 10. The amount of back off ($\Delta$) is the difference in dB between the output power of the microwave output signal and the saturated microwave output power. The linearity requirement may be determined by a multiple tone communications application.

Figure 3:
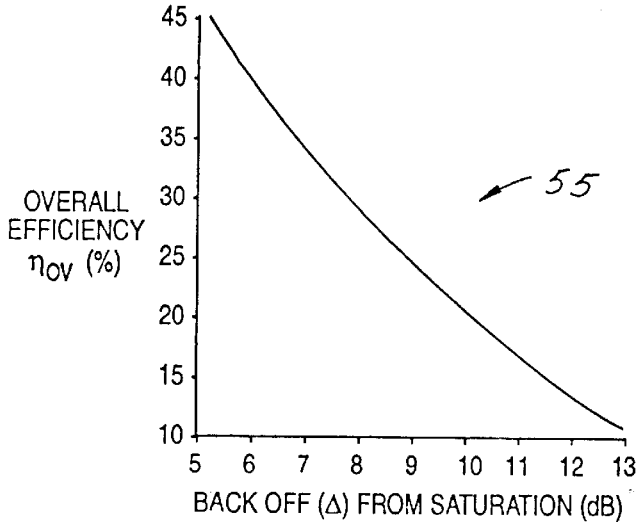
FIG. 3 is a graph of the overall efficiency ($\eta_{ov}$) as a function of the amount of back off ($\Delta$) from saturation in dB.

Referring now to FIG. 3, a graph 55 of the overall efficiency $\eta_{ov}$ as a function of the amount of back off ($\Delta$) is shown. Graph 55 assumes a basic efficiency $\eta_b$ of 25% and a collection efficiency $\eta_{coll}$ of 90%. As shown by graph 55, the overall efficiency $\eta_{ov}$ is a strong function of the amount of back off ($\Delta$). To obtain an overall efficiency $\eta_{ov}$ of greater than 20%, the amount of back off ($\Delta$) cannot be greater than 10 dB. Correspondingly, for a communication application requiring a high linearity such that the amount of back off ($\Delta$) is greater than 10 dB, a higher collection efficiency $\eta_{coll}$ (or a higher electronic efficiency $\eta_e$) must be achieved to obtain an overall efficiency $\eta_{ov}$ of at least 20%.

Figure 4:
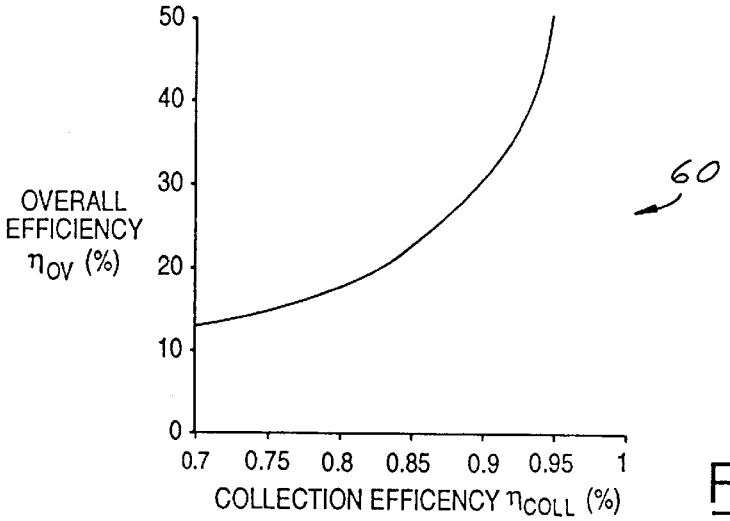
FIG. 4 is a graph of the overall efficiency ($\eta_{ov}$) as a function of the collection efficiency ($\eta_{coll}$) for a given amount of back off ($\Delta$)

Referring now to FIG. 4, a graph 60 of the overall efficiency $\eta_{ov}$ as a function of the collection efficiency $\eta_{coll}$ for a given amount of back off ($\Delta$) is shown. Graph 60 assumes a back off ($\Delta$) of 8 dB and a basic efficiency $\eta_b$ of 25%. As shown by graph 60, the overall efficiency $\eta_{ov}$ can be increased from 12% to 30% by increasing the collection efficiency $\eta_{coll}$ from 70% to 90%. With a collection efficiency $\eta_{coll}$ of 90%, the overall efficiency $\eta_{ov}$ starts to exponentially increase. For instance with a collection efficiency $\eta_{coll}$ of 95%, the overall efficiency $\eta_{ov}$ is 50% and graph 60 has an extremely high slope at this point.

Thus, traveling wave tube 10 is operated and designed to achieve a high collection efficiency $\eta_{coll}$. Traveling wave tube 10 is operated at an amount of back off ($\Delta$) such that the microwave output power is at least 3 to 25 dB below the saturated microwave output power (or at least 1 dB below the gain compression point). The microwave output power is also roughly six to fifty times below the power of electron beam 17. With an amount of back off ($\Delta$) of at least 3 dB and such a relatively high power electron beam, electrons in electron beam 17 have a small energy spread and a general axial velocity.

In short, during backed off operation, electron beam 17 is not greatly changed or perturbed by the presence of the microwave signal. In fact, electron beam 17 appears similar to the electron beam that occurs when traveling wave tube 10 is operating with microwave source 30 shut off. In particular, the electrons in electron beam 17 have a small energy spread and a general axial velocity with minimal radial velocity components. When microwave source 30 is shut off and is not supplying a microwave input signal, traveling wave tube 10 is referred to as operating at DC.

Because of the characteristics of electron beam 17 during backed off operation, collector assembly 16 collects a significantly higher percentage of the spent beam power than what the assembly collects when traveling wave tube 10 is operating at saturation. Particularly, each additional collector electrode or stage added to the typical four collector electrode collector assembly is effective in collecting a portion of the spent electron beam power.

Typically, traveling wave tubes are designed to operate at saturation. At saturation, the electron beam has a large energy spread. The electrons in the electron beam also have axial and large radial velocity components. Thus, the collection efficiency of a collector assembly having four collector electrodes or stages does not increase significantly with additional electrodes. Accordingly, operating at saturation, there is seldom a reason to add more electrodes.

Furthermore, because of the large divergence of the electron beam in the collector at saturation, the geometry of the electrodes is configured to handle a highly divergent beam. The voltages applied to the electrodes are also set to handle a highly divergent beam. This is required to keep the backstreaming current to an acceptable low level, typically less than 5% of the cathode current.

Figure 5:
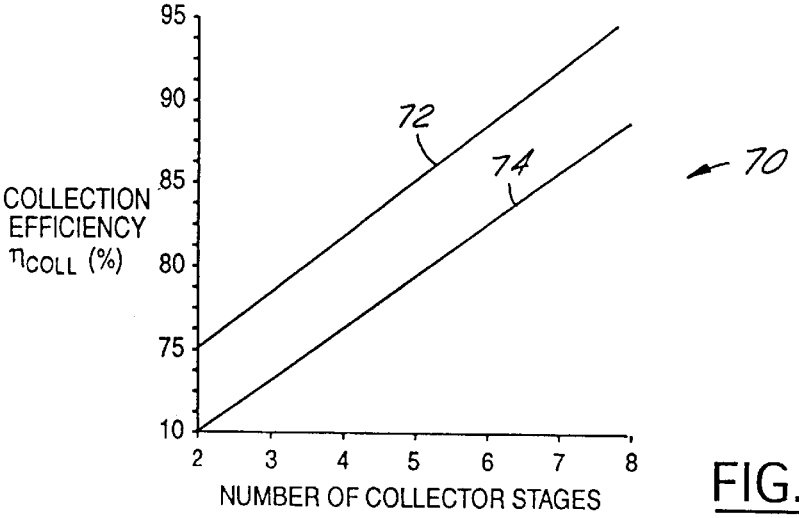
FIG. 5 is a graph of the collection efficiency ($\eta_{coll}$) as a function of the number of collector electrodes or stages of the collector assembly.

Referring now to FIG. 5, a graph 70 of the collection efficiency $\eta_{coll}$ as a function of the number of collector electrodes of collector assembly 16 is shown. Graph 70 includes experimentally measured data plots 72 and 74 showing the collection efficiency $\eta_{coll}$ as a function of the number of collector electrodes when traveling wave tube 10 is operating at DC and 8 dB backed off from saturation, respectively. Plot 74 shows that a traveling wave tube operating 8 dB backed off from saturation and having a seven stage collector assembly has a collection efficiency $\eta_{coll}$ of 85%. As traveling wave tube 10 is operated farther from saturation, electron beam 17 obtains more of the characteristics of the electron beam at DC operation. Plot 72 shows that with DC operation of traveling wave tube 10, a seven stage collector has a collection efficiency of over 90%.

As pointed out in FIG. 2, the overall efficiency $\eta_{ov}$ greatly increases with larger collection efficiencies. Graph 70 provides the motivation to add more collector electrodes because it shows that when a traveling wave tube is operating backed off from saturation, employing additional collector electrodes is worthwhile.

Figure 6:
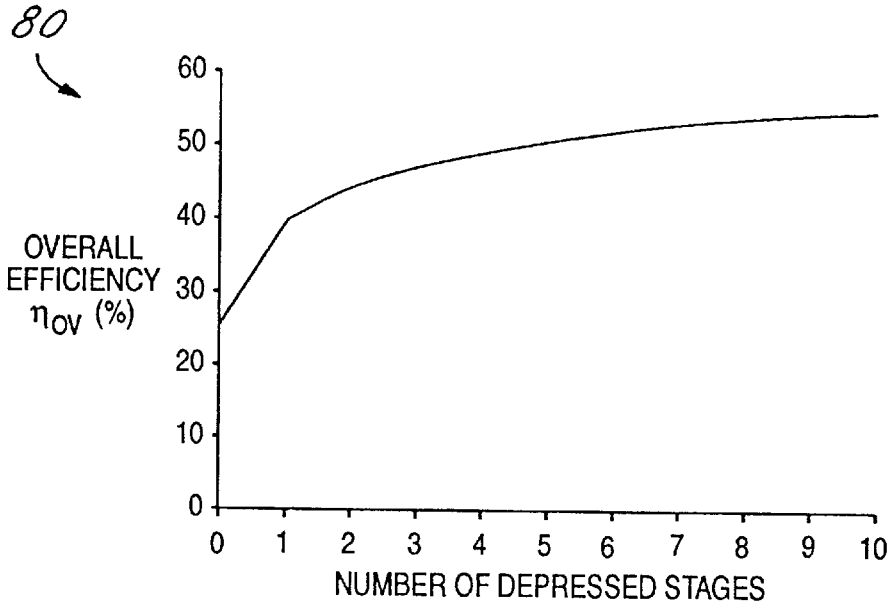
(PRIOR ART) FIG. 6
FIG. 6 is a graph of the overall efficiency ($\eta_{ov}$) as a function of the number of collector electrodes of a typical traveling wave tube operating at saturation.

Referring now to FIG. 6, a graph 80 of the overall efficiency $\eta_{ov}$ as a function of the number of collector electrodes for typical traveling wave tubes operating at saturation is shown. Graph 80 shows that the increase in the overall efficiency $\eta_{ov}$ with more than four electrodes is so small that it is not worthwhile to have a collector assembly with more than four electrodes. Thus, typical traveling wave tubes, unlike traveling wave tube 10, have collector assemblies with not more than four collector electrodes.

As shown, the apparatus and method of the present invention has many attendant advantages. Traveling wave tube 10 is designed for linearity and efficiency during back off operation. Thus, the collector is optimized with at least four collector electrodes for near DC electron beam recovery of a traveling wave tube running backed off. The efficiency of the optimized collector is much higher than the efficiency of a typical collector designed for a traveling wave tube running at saturation.

Furthermore, the apparatus and method of the present invention satisfy the need for higher power microwave amplifiers in the growing area of cellular communications. The present invention offers high linearity and desired power levels compared to existing solid state amplifiers.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and broad scope of the appended claims.

What is claimed is:

1. A traveling wave tube comprising:

a slow wave structure (SWS) having an input end for receiving a microwave input signal having a power level and an output end for supplying a microwave output signal having a power level;

a microwave source connected to the input end of the SWS for applying the microwave input signal to the SWS;

an electron gun assembly adjacent the input end of the SWS and having a cathode for injecting electrons as an electron beam through the SWS; and a collector assembly adjacent the output end of the SWS and having at least five collector electrodes for collecting the electrons in the electron beam;

wherein the power level of the microwave input signal is selected such that the power level of the microwave output signal is at least 3 dB lower than a power level of the microwave output signal when the traveling wave tube is operating at saturation;

wherein a geometry of the collector electrodes is dimensioned and respective bias voltages applied to the corresponding collector electrodes are selected to optimally handle the electron beam when the traveling wave tube is operating at least 3 dB backed off from saturation so as to maximize the collection efficiency, and wherein the geometry is dimensioned and the respective bias voltages are selected such that the collector assembly generates a backstreaming current greater than 5% of a cathode current in the traveling wave tube when the traveling wave tube is operating at saturation.

2. The traveling wave tube of claim 1 wherein:

the electron beam has a power level and the power level of the microwave input signal is selected such that the power level of the microwave output signal is six to fifty times lower than the power level of the electron beam.

3. A method for operating a traveling wave tube provided with a slow wave structure (SWS) having an input end for receiving a microwave input signal having a power level and an output end for supplying a microwave output signal having a power level, the traveling wave tube further provided with a collector assembly having at least five electrodes, the method comprising:

injecting electrons at the input end of the SWS to form an electron beam through the SWS, wherein the electron beam has a power level;

applying the microwave input signal to the input end of the SWS, wherein the power level of the microwave input signal is selected such that the power level of the microwave output signal is at least twenty five times lower than the power level of the electron beam and such that the power level of the microwave output signal is at least 3 dB lower than a power level of the microwave output signal when the traveling wave tube is operating at saturation; and collecting the electrons in the electron beam at the output end of the SWS with the collector assembly, wherein a geometry of the collector electrodes is dimensioned and respective bias voltages applied to the corresponding collector electrodes are selected to optimally handle the electron beam when the traveling wave tube is operating at least 3 dB backed off from saturation so as to maximize the collection efficiency, and wherein the geometry is dimensioned and the respective bias voltages are selected such that the collector assembly generates a backstreaming current greater than 5% of a cathode current in the traveling wave tube when the traveling wave tube is operating at saturation.

4. A method for operating a traveling wave tube provided with a slow wave structure (SWS) having an input end for receiving a microwave input signal having a power level and an output end for supplying a microwave output signal having a power level, the traveling wave tube further provided with a collector assembly having at least ive electrodes, the method comprising:

injecting electrons at the input end of the SWS to form an electron beam through the SWS;

applying the microwave input signal to the input end of the SWS, wherein the power level of the microwave input signal is selected such that the power level of the microwave output signal is at least 3 dB lower than a power level of the microwave output signal when the traveling wave tube is operating at saturation; and collecting the electrons in the electron beam at the output end of the SWS with the collector assembly, wherein a geometry of the collector electrodes is dimensioned and respective bias voltages applied to the corresponding collector electrodes are selected to optimally handle the electron beam when the traveling wave tube is operating at least 3 dB backed off from saturation so as to maximize the collection efficiency, and wherein the geometry is dimensioned and the respective bias voltages are selected such that the collector assembly generates a backstreaming current greater than 5% of a cathode current in the traveling wave tube when the traveling wave tube is operating at saturation.

5. The method of claim 4 wherein:

the electron beam has a power level and the power level of the microwave input signal is selected such that the power level of the microwave output signal is six to fifty times lower than the power level of the electron beam.

* * * * *